US005473791A

United States Patent [19]

Holcomb et al.

[11] Patent Number: 5,473,791

[45] Date of Patent: Dec. 12, 1995

[54] PAINT ROLLER AND TRAY APPARATUS

[76] Inventors: Tim C. Holcomb; Kenneth A. Holcomb, both of 2630 Laurel La., Sycamore, Ill. 60178

[21] Appl. No.: 310,482

[22] Filed: Sep. 22, 1994

[51] Int. Cl.[6] ..... B05C 17/02; B05C 21/00; B44D 3/12

[52] U.S. Cl. ..... 15/230.11; 15/257.06

[58] Field of Search ..... 15/230.11, 257.06; D32/53.1; 492/13

[56] References Cited

U.S. PATENT DOCUMENTS

| | | | |
|---|---|---|---|
| D. 282,882 | 3/1986 | Allison et al. . | |
| D. 286,458 | 10/1986 | Pages | D32/53.1 |
| D. 327,775 | 7/1992 | Boyer . | |
| D. 328,808 | 8/1992 | Goetz . | |
| 2,538,241 | 1/1951 | Guimond | 15/230.11 |
| 2,758,364 | 8/1956 | McMillan | 15/230.11 |
| 2,929,089 | 3/1960 | Nall | 15/230.11 |
| 2,994,899 | 8/1961 | Moilanen | 15/230.11 |
| 4,025,205 | 5/1977 | Hawk | 15/230.11 |
| 4,197,338 | 4/1980 | Perna | 15/230.11 |
| 4,263,690 | 4/1981 | Dobosi | 15/230.11 |
| 4,651,379 | 3/1987 | Kern | 15/257.06 |
| 4,815,604 | 1/1993 | O'Neil et al. . | |

FOREIGN PATENT DOCUMENTS

| | | | |
|---|---|---|---|
| 519411 | 5/1953 | Belgium | 15/230.11 |
| 2172820 | 10/1986 | United Kingdom | 15/230.11 |

*Primary Examiner*—Edward L. Roberts, Jr.

[57] ABSTRACT

A roller and tray apparatus includes a roller assembly which includes a handle portion, a bearing portion connected to the handle portion, and a replaceable porous roller portion connected to the bearing portion. The roller portion includes a first canted peripheral edge adapted to contact a first interior surface adjacent to an interior corner without contacting a second interior surface adjacent to the interior corner. A tray assembly includes a squeeze area for receiving the roller portion for squeezing out excess coating material from the roller portion. The squeeze area includes a first canted wall portion which is complementary to the first canted peripheral edge and is adapted to squeeze excess coating material out of the roller portion. The roller portion may also include a second canted peripheral edge adapted to contact a second interior surface adjacent to the interior corner without contacting the first interior surface adjacent to the interior corner. The second canted peripheral edge and the first canted peripheral edge are juxtaposed back-to-back to each other, whereby they form an exterior corner that is complementary to the interior corner. The squeeze area of the tray assembly includes a second canted wall portion which is complementary to the second canted peripheral edge and is adapted to squeeze excess coating material out of the roller portion. The first canted wall portion and the second canted wall portion are juxtaposed to each such that they form an angled groove which is complementary to the exterior corner.

7 Claims, 4 Drawing Sheets

FIG 1
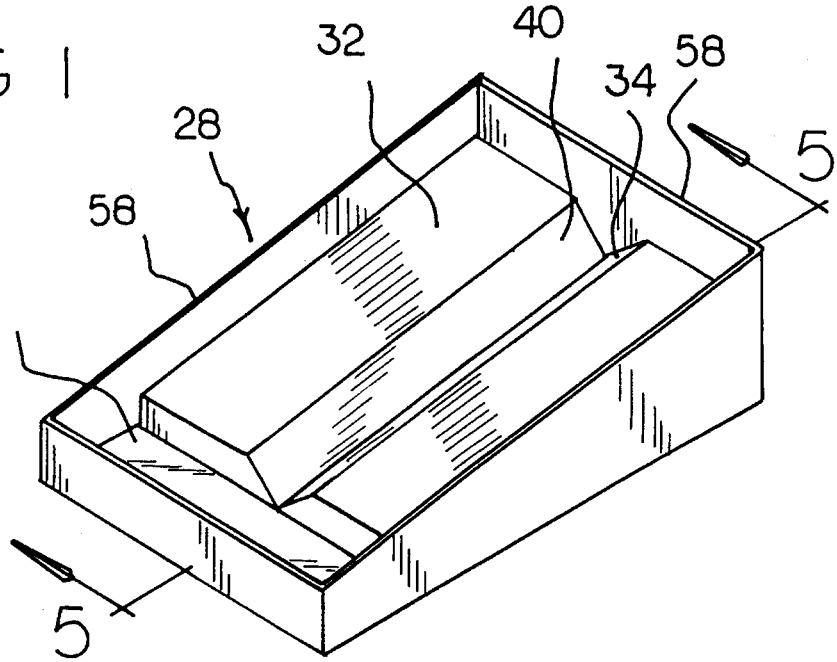
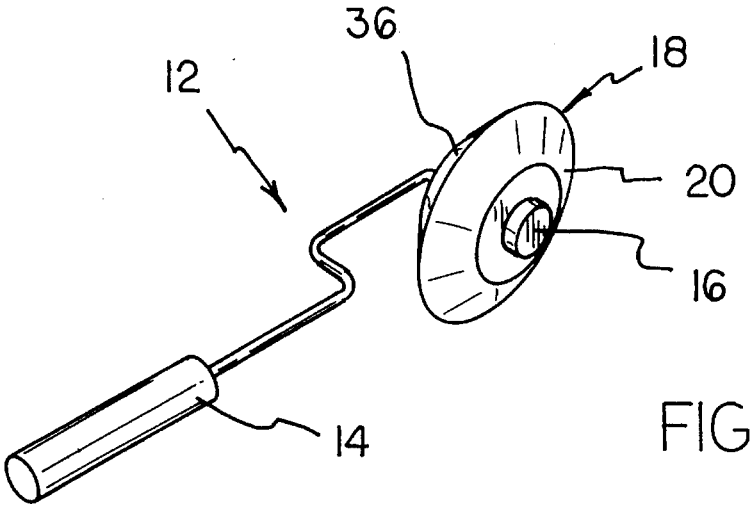
FIG 2

FIG 5
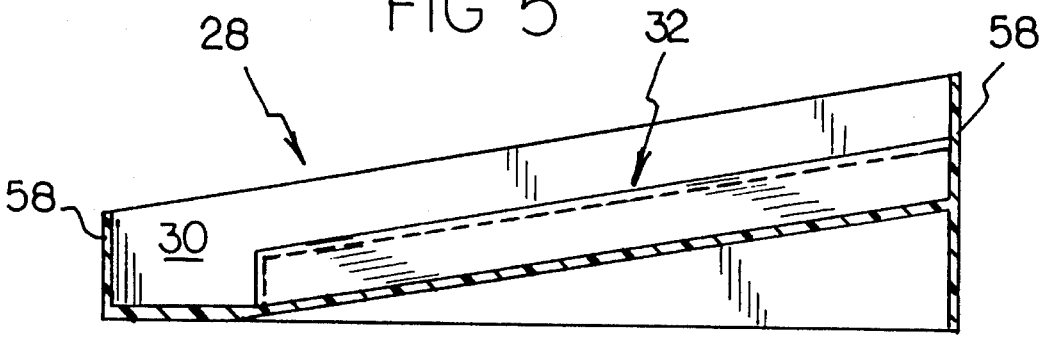
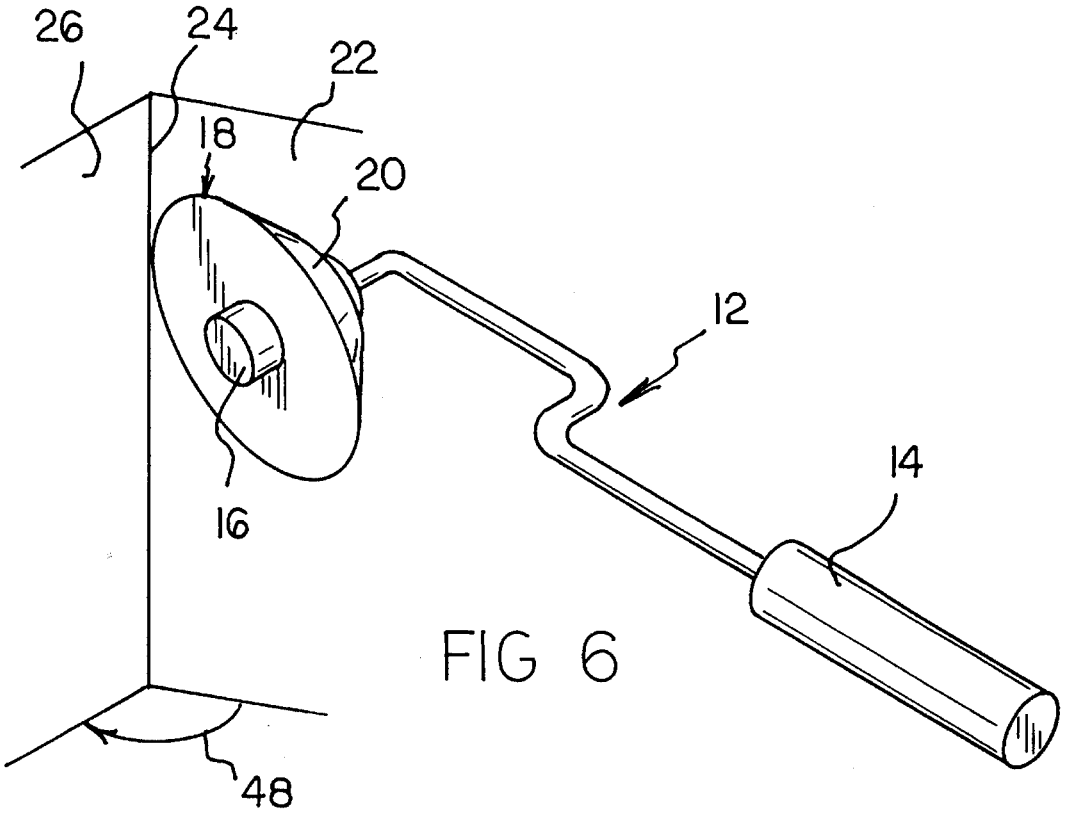
FIG 6

FIG 7
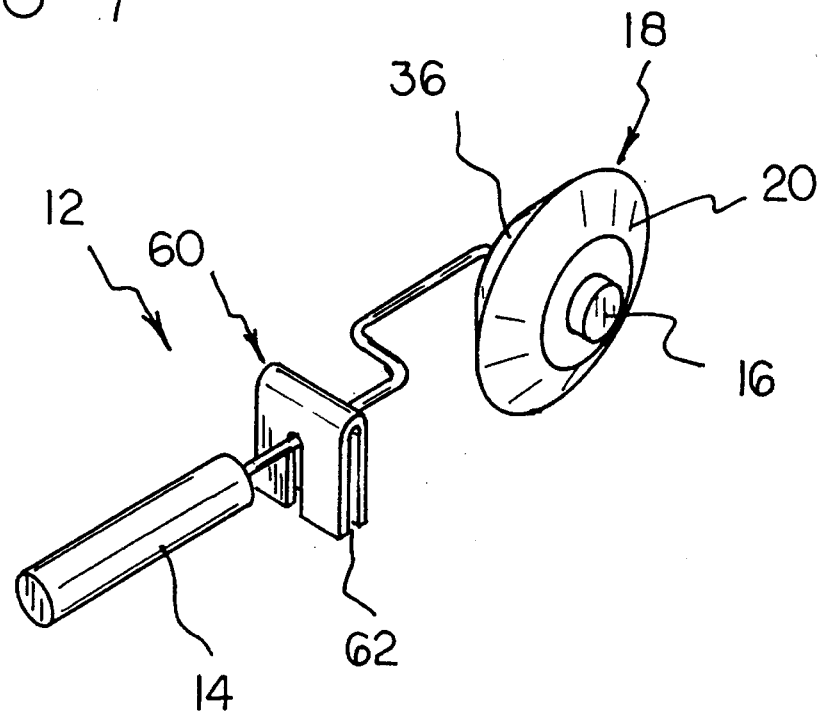
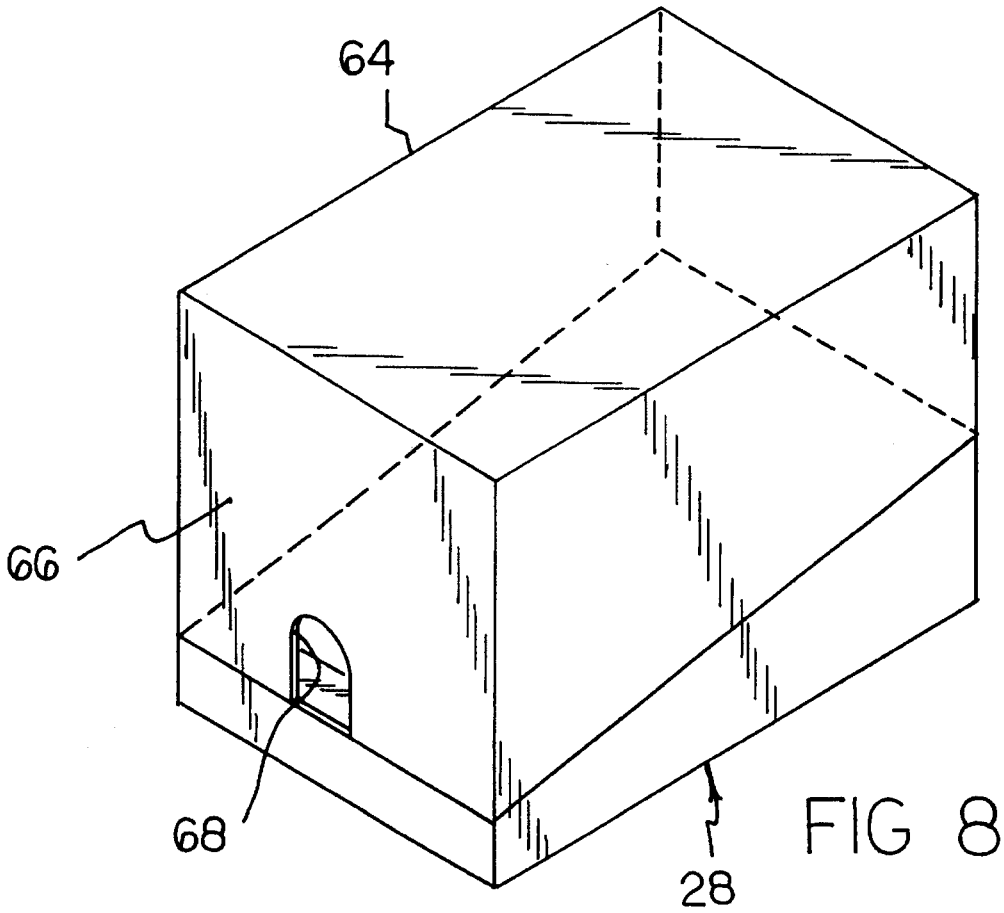
FIG 8

PAINT ROLLER AND TRAY APPARATUS

BACKGROUND OF THE INVENTION

1. Field of the Invention

The present invention relates generally to devices used for painting and, more particularly, to roller devices for painting and the trays used with the roller devices.

2. Description of the Prior Art

Roller devices are often used for painting, and special trays are especially adapted for use with the rollers. Conventional rollers have cylindrical shapes, and a trays are designed to accommodate the cylindrical rollers. For example, the following U.S. patents disclose trays especially adapted for use with conventional paint rollers: U.S. Pat. Nos. 4,815,604; Des. 282,882; Des. 286,458; Des. 327,755; and Des. 328,808.

There are a number of deficiencies associated conventional cylindrical rollers. For example, interior corners result from the intersection of two planar wall surfaces, generally at a right angle. To paint such corners with a conventional cylindrical roller would require at least two passes. One pass for one wall and the other pass for the other wall. To same time in painting, it would be desirable if an interior corner of a room could be painted with roller with only one pass required to paint both wall near the intersection at the corner.

Even if only one wall is to be painted in the vicinity of an interior corner, the use of a conventional cylindrical roller makes this task difficult. There is a tendency of the sides of the conventional cylindrical roller to rub up against the wall surface that is not to be painted and cause an undesirable mess. Therefore, it would be desirable if a roller were provided which permits a painting of one wall near an interior corner without rubbing up against the other wall at the corner.

Trays that are used with conventional cylindrical rollers generally have two major tray areas. There is one area for loading the roller with paint, and there is a second area on which excess paint can be squeezed out of the roller. In this respect, it would be desirable if a tray were provided that includes an area especially adapted for squeezing excess paint out of a roller designed to paint two wall surfaces at an interior corner simultaneously.

There are times when it may be desirable to store a roller on a tray without permitting the roller to enter the area of the tray where the roller is loaded with paint. In this respect, it would be desirable if a roller were provided with a device that prevents the roller from undesirably entering the area of the tray where roller loading takes place.

There are times when a painting job cannot be finished in a single continuous time frame. At such times, there are two approaches that can be taken. Either the roller and tray are cleaned and stored for future use or the roller and tray are stored in the presence of paint without being cleaned. Roller trays are generally provided without covers. Therefore, an undesirable amount of solvent or vehicle may evaporate from the paint if the roller and tray are stored in the presence of paint without being cleaned. To avoid this problem, it would be desirable if a roller and tray combination were provided that permits storage of the roller and tray in the presence of paint without permitting an undesirable amount of solvent evaporation from the paint.

Thus, while the foregoing body of prior art indicates it to be well known to use conventional cylindrical paint rollers and trays, the prior art described above does not teach or suggest a paint roller and tray apparatus which has the following combination of desirable features: (1) permits an interior corner of a room to be painted with a roller with only one pass required to paint both walls near the intersection at the corner; (2) permits painting one wall near an interior comer without rubbing up against the other wall at the corner; (3) includes a tray area especially adapted for squeezing excess paint out of a special roller designed to paint two wall surfaces at an interior corner simultaneously; (4) provides a device to prevent the roller from undesirably entering the area of the tray where roller loading takes place; and (5) permits storage of the roller and tray in the presence of paint without permitting an undesirable amount of solvent evaporation from the paint. The foregoing desired characteristics are provided by the unique paint roller and tray apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a roller and tray apparatus which includes a roller assembly which includes a handle portion, a bearing portion connected to the handle portion, and a replaceable porous roller portion connected to the bearing portion. The roller portion includes a porous material which is adapted to soak up and dispense a quantity of a coating material onto a surface. The roller portion includes a first canted peripheral edge adapted to contact a first interior surface adjacent to an interior corner without contacting a second interior surface adjacent to the interior corner. Also, in accordance with the invention, a tray assembly includes a pool region adapted to contain a quantity of coating material and also includes a squeeze area adjacent to the pool region for receiving the roller portion for squeezing out excess coating material from the roller portion. The squeeze area includes a first canted wall portion which is complementary to the first canted peripheral edge and is adapted to squeeze excess coating material out of the roller portion.

The roller portion may also include a second canted peripheral edge adapted to contact a second interior surface adjacent to the interior corner without contacting the first interior surface adjacent to the interior corner. The second canted peripheral edge and the first canted peripheral edge are juxtaposed back-to-back to each other, whereby they form an exterior corner that is complementary to the interior corner.

The squeeze area of the tray assembly includes a second canted wall portion which is complementary to the second canted peripheral edge and is adapted to squeeze excess coating material out of the roller portion. The first canted wall portion and the second canted wall portion are juxtaposed to each such that they form an angled groove which is complementary to the exterior corner formed by the back-to-back first canted peripheral edge and the second canted peripheral edge.

The juxtaposed first canted peripheral edge and second canted peripheral edge are formed as a unified, integrated structure. The exterior corner formed by the back-to-back first canted peripheral edge and second canted peripheral edge has an outer corner angle which is approximately a right angle.

The bearing portion of the roller assembly includes a first end-bearing member rotatably is connected to the handle portion. A plurality of resilient bands may be connected to the first end-bearing member, and a second end-bearing member is connected to the resilient bands. The squeeze area of the tray assembly is canted with respect to the pool region.

In accordance with another aspect of the invention, a wall-clip assembly may be attached to the roller assembly. The wall-clip assembly is adapted to engage and be supported by a wall of the tray assembly. The wall-clip assembly may include an inverted U-shaped member adapted to fit over an edge of a wall.

In accordance with another embodiment of the invention, a cover assembly may be adapted to fit over the pool region and the squeeze area of the tray assembly and is adapted to be supported by the walls of the tray assembly. The cover assembly includes a side wall which includes a cut-out portion which provides a clearance between the handle portion of the roller assembly and the side wall when the cover assembly is placed on the tray assembly.

In accordance with another aspect of the invention, a roller assembly includes a handle portion, a bearing portion connected to the handle portion, and a replaceable porous roller portion connected to the bearing portion. The roller portion includes a first canted peripheral edge adapted to contact a first interior surface adjacent to an interior corner without contacting a second interior surface adjacent to the interior corner.

In accordance with yet another aspect of the invention, the roller portion of the roller assembly includes a second canted peripheral edge adapted to contact a second interior surface adjacent to the interior corner without contacting the first interior surface adjacent to the interior corner. The second canted peripheral edge and the first canted peripheral edge are juxtaposed back-to-back to each other, whereby they form an exterior corner that is complementary to the interior corner.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint roller and tray apparatus which has all of the advantages of the prior art and none of the disadvantages.

It is another object of the present invention to provide a new and improved paint roller and tray apparatus which may be easily and efficiently manufactured and marketed.

It is a further object of the present invention to provide a new and improved paint roller and tray apparatus which is of durable and reliable construction.

An even further object of the present invention is to provide a new and improved paint roller and tray apparatus which is susceptible of a low cost of manufacture with regard to both materials and labor, and which accordingly is then susceptible of low prices of sale to the consuming public, thereby making such paint roller and tray apparatus available to the buying public.

Still yet a further object of the present invention is to provide a new and improved paint roller and tray apparatus which permits an interior corner of a room to be painted with a roller with only one pass required to paint both walls near the intersection at the corner.

Still another object of the present invention is to provide a new and improved paint roller and tray apparatus that permits painting one wall near an interior corner without rubbing up against the other wall at the corner.

Yet another object of the present invention is to provide a new and improved paint roller and tray apparatus which includes a tray area especially adapted for squeezing excess paint out of a special roller designed to paint two wall surfaces at an interior corner simultaneously.

Even another object of the present invention is to provide a new and improved paint roller and tray apparatus that provides a device to prevent the roller from undesirably entering the area of the tray where roller loading takes place.

Still a further object of the present invention is to provide a new and improved paint roller and tray apparatus which permits storage of the roller and tray in the presence of paint without permitting an undesirable amount of solvent evaporation from the paint.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of a tray assembly of a paint roller and tray apparatus of the invention.

FIG. 2 is a perspective view showing a first embodiment of a roller assembly of the paint roller and tray apparatus of the invention.

FIG. 5 is an enlarged cross-sectional view of the tray assembly of FIG. 1 taken along line 5—5 of FIG. 1.

FIG. 6 is a perspective view of a second embodiment of a roller assembly which is adapted to paint only one wall at an interior corner.

FIG. 7 is a perspective view of a third embodiment of a roller assembly which is adapted to be supported by a tray assembly portion.

FIG. 8 is a perspective view of a portion of a fourth embodiment of the invention which includes a tray cover and a port in the tray cover which permits a handle of a roller assembly portion to stick out from the tray cover.

DESCRIPTION OF THE PREFERRED EMBODIMENT

Figure 3:
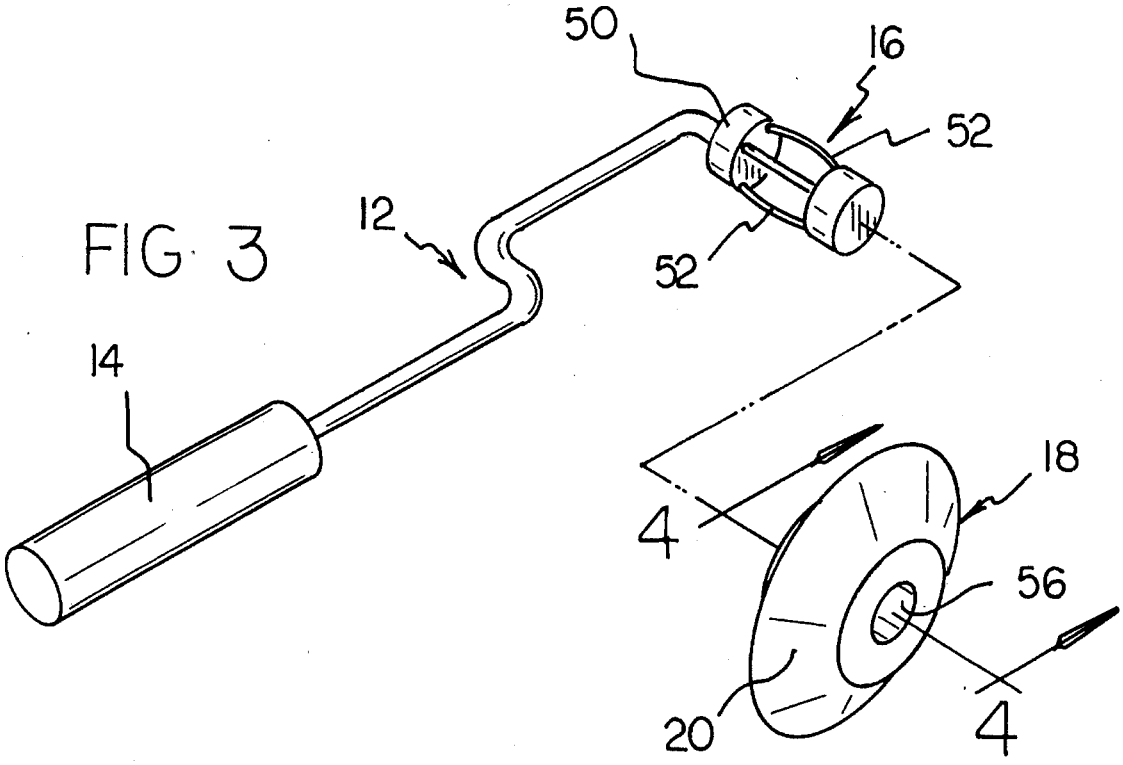
FIG. 3 is an exploded perspective view of the embodiment of the roller assembly shown in FIG. 2 taken along line 2—2 of FIG. 1.

With reference to the drawings, a new and improved paint roller and tray apparatus embodying the principles and concepts of the present invention will be described.

Turning to FIGS. 1–6, there is shown a first embodiment of the paint roller and tray apparatus of the invention which includes a roller assembly 12 in FIG. 2 and a tray assembly 28 in FIG. 1. The roller assembly 12 includes a handle portion 14, a bearing portion 16 connected to the handle portion 14, and a replaceable porous roller portion 18 connected to the bearing portion 16. The roller portion 18 includes a porous material which is adapted to soak up and dispense a quantity of a coating material onto a surface.

The roller portion 18 includes a first canted peripheral edge 20 adapted to contact a first interior surface 22 adjacent to an interior corner 24 without contacting a second interior surface 26 adjacent to the interior corner 24. See the embodiment of the roller portion 18 shown in FIG. 6 which may be referred to as a half-corner embodiment of the roller portion 18.

Also, in accordance with the invention, a tray assembly 28 includes a pool region 30 adapted to contain a quantity of coating material and also includes a squeeze area 32 adjacent to the pool region 30 for receiving the roller portion 18 for squeezing out excess coating material from the roller portion 18. The squeeze area 32 includes a first canted wall portion 34 which is complementary to the first canted peripheral edge 20 and is adapted to squeeze excess coating material out of the roller portion 18.

Figure 4:
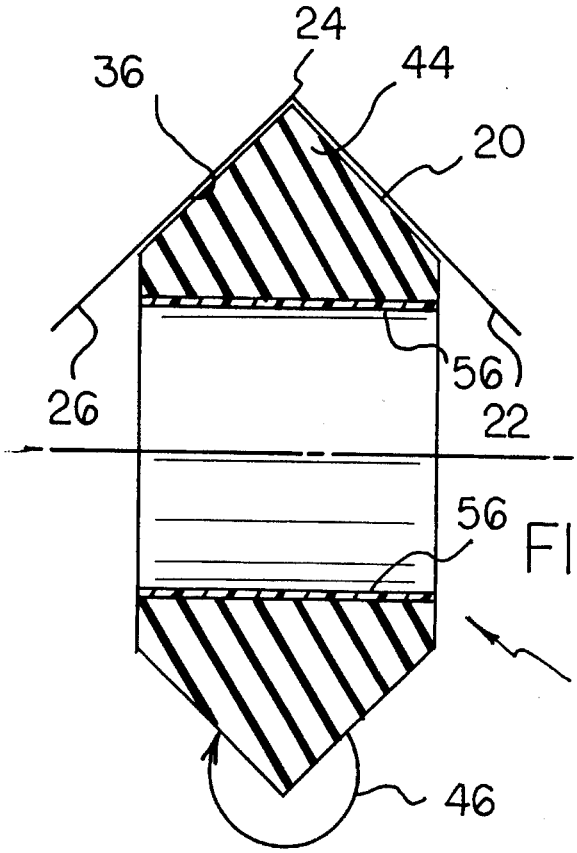
FIG. 4 is a cross-sectional view of the roller portion of FIG. 3 taken along line 3—3 thereof.

In accordance with another aspect of the invention, as especially shown in FIGS. 2, 3, and 6, the roller portion 18 can include a second canted peripheral edge 36 adapted to contact a second interior surface 38 adjacent to the interior corner 24 without contacting the first interior surface 22 adjacent to the interior corner 24. The second canted peripheral edge 36 and the first canted peripheral edge 20 are juxtaposed back-to-back to each other, whereby they form an exterior corner 44 that is complementary to the interior corner 24. The squeeze area 32 includes a second canted wall portion 40 which is complementary to the second canted peripheral edge 36 and is adapted to squeeze excess coating material out of the roller portion 18, and the first canted wall portion 34 and the second canted wall portion 40 are juxtaposed to each such that they form an angled groove 42 which is complementary to the exterior corner 44 formed by the back-to-back first canted peripheral edge 20 and the second canted peripheral edge 36. as shown in FIG. 4, the juxtaposed first canted peripheral edge 20 and second canted peripheral edge 36 are formed as a unified, integrated structure.

The exterior corner 44 formed by the back-to-back first canted peripheral edge 20 and second canted peripheral edge 36 has an outer corner angle 46 which is approximately a right angle. The interior corner 24 has an interior corner angle 48 which is also approximately a right angle. The bearing portion 16 of the roller assembly 12 includes a first end-bearing member 50 rotatably connected to the handle portion 14. A plurality of resilient bands 52 are connected to the first end-bearing member 50, and a second end-bearing member 54 is connected to the resilient bands 52. The resilient bands 52 press up against an interior wall surface 56 of the roller portion 18 when the roller portion 18 is installed on the resilient bands 52 of the bearing portion 16. The resilient bands 52 may be made from metal or plastic materials. The squeeze area 32 of the tray assembly 28 is canted with respect to the pool region 30. The canted aspect of the squeeze area 32 permits squeezed out coating material to flow from the squeeze area 32 into the pool region 30 of the tray assembly 28. Another feature of the tray assembly 28 is the presence of walls 58 defining the pool region 30 and encompassing the squeeze area 32.

Turning to FIG. 7, a third embodiment of the roller assembly 12 of the invention is shown. Reference numerals are shown that correspond to like reference numerals that designate like elements shown in the other figures. In addition, a wall-clip assembly 60 attached to the roller assembly 12. The wall-clip assembly 60 is adapted to engage and be supported by a wall 58 of the tray assembly 28. The wall-clip assembly 60 permits the roller assembly 12 to be supported by a wall 58 so that the roller portion 18 does not enter the pool region 30 of the tray assembly 28. In other words, the wall-clip assembly 60 permits the roller portion 18 to be stored without soaking up coating material from the pool region 30. The wall-clip assembly 60 includes an inverted U-shaped member 62 adapted to fit over an edge of a wall 58. The wall-clip assembly 60 can also be in the form of hook-like grooves that are placed in a handle portion 14 of the roller assembly 12.

The handle portion 14 of the roller assembly 12 can have threaded ends to allow the use of different size extension handles. If desired, a handy hint sheet can be available to the user. One useful hint is to use a thin piece of cardboard at the ceiling and base conjunctions of the interior corner 24 so that paint can be rolled down to the base and up to the ceiling without getting wall color (if different from the ceiling color) on the ceiling or base.

Turning to FIG. 8, a portion of a fourth embodiment of the invention is shown. Reference numerals are shown that correspond to like reference numerals that designate like elements shown in the other figures. In addition, a cover assembly 64 is adapted to fit over the pool region 30 and the squeeze area 32 of the tray assembly 28 and is adapted to be supported by the walls 58 of the tray assembly 28. The cover assembly 64 includes a side wall 66 which includes a cut-out portion 68 which provides a clearance between the handle portion 14 of the roller assembly 12 and the side wall 66 when the cover assembly 64 is placed on the tray assembly 28. When the cover assembly 64 is placed over a tray assembly 28 which includes some liquid coating material and which is supporting the roller assembly 12, the entire apparatus can be stored in a refrigerator without pre-cleaning the tray assembly 28 and the roller assembly 12.

In general use, a quantity of a liquid coating material, e.g. paint, is poured into the pool region 30. A person grasps the handle portion 14 of the roller assembly 12 and dunks the roller portion 18 of the roller assembly 12 into the liquid coating material. After a suitable amount of liquid coating material has been soaked into the roller portion 18 of the roller assembly 12, the roller portion 18 is moved to the angled groove 42 in the squeeze area 32, and the roller portion 18 is rolled along the angled groove 42 to squeeze out excess liquid coating material. Then, the exterior corner 44 of the roller portion 18 is placed at the interior corner 24 formed by the first interior surface 22 and the second interior surface 26. Then, the roller portion 18 is rolled along the interior corner 24 to apply liquid coating material to both the first interior surface 22 and the second interior surface 26 simultaneously.

The roller and tray apparatus 10 of the invention, especially the embodiment shown in FIGS. 1–5, is eminently suited for edging walls at interior corners, especially with flat or eggshell sheens. The embodiment of the invention shown in FIG. 6 (the half-corner embodiment) would work well with all sheen levels, but especially with higher sheens like semi-gloss. An important point is to keep a wet edge. The half-corner embodiment can also be used for doing accent walls and perhaps base areas of walls and perhaps even the top of the wall near the ceiling. The embodiment of the invention shown in FIG. 6 would also work well when painting a wall that is a different color from other walls.

To be suitably absorbent, the roller portion 18 of the roller assembly 12 is made from absorbent material such as sponge or foam-like material. Although an interior corner 22 is usually 90 degrees, the outer corner angle 46 of the roller portion 18 shown in FIG. 4 may be 90 degrees or less than 90 degrees. Whether the angle of the interior corner 24 is exactly equal to the outer corner angle 46 of the roller portion 18 depends upon a number of factors which include the thickness and the compression rate of the material of which the roller portion 18 is comprised and the amount of pressure applied to the roller portion 18.

The components of the paint roller and tray apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved paint roller and tray apparatus that is low in cost, relatively simple in design and operation, and which may advantageously be used to permit an interior corner of a room to be painted with a roller with only one pass required to paint both walls near the intersection at the corner. With the invention, a paint roller and tray apparatus is provided which permits painting one wall near an interior corner without rubbing up against the other wall at the corner. With the invention, a paint roller and tray apparatus is provided which includes a tray area especially adapted for squeezing excess paint out of a special roller designed to paint two wall surfaces at an interior corner simultaneously. With the invention, a paint roller and tray apparatus provides a device to prevent the roller from undesirably entering the area of the tray where roller loading takes place. With the invention, a paint roller and tray apparatus is provided which permits storage of the roller and tray in the presence of paint without permitting an undesirable amount of solvent evaporation from the paint.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A roller and tray apparatus, comprising:

a roller assembly which includes a handle portion, a bearing portion connected to said handle portion, and a replaceable porous roller portion connected to said bearing portion, wherein said roller portion includes a porous material which is adapted to soak up and dispense a quantity of a coating material onto a surface, and wherein said roller portion includes a first canted peripheral edge adapted to contact a first interior surface adjacent to an interior corner without contacting a second interior surface adjacent to the interior corner, a tray assembly which includes a pool region adapted to contain a quantity of coating material and includes a squeeze area adjacent to said pool region for receiving said roller portion for squeezing out excess coating material from said roller portion, wherein said squeeze area includes a first canted wall portion which is complementary to said first canted peripheral edge and is adapted to squeeze excess coating material out of said roller portion, a wall-clip assembly attached to said roller assembly, wherein said wall-clip assembly is adapted to engage and be supported by a wall of said tray assembly, and a cover assembly adapted to fit over said pool region and said squeeze area of said tray assembly and adapted to be supported by said walls of said tray assembly, wherein said cover assembly includes a side wall which includes a cut-out portion which provides a clearance between said handle portion of said roller assembly and said side wall when said cover assembly is placed on said tray assembly.

2. The apparatus of claim 1 wherein:

said roller portion includes a second canted peripheral edge adapted to contact a second interior surface adjacent to the interior corner without contacting the first interior surface adjacent to the interior corner, wherein said second canted peripheral edge and said first canted peripheral edge are juxtaposed back-to-back to each other, whereby they form an exterior corner that is complementary to the interior corner, said squeeze area includes a second canted wall portion which is complementary to said second canted peripheral edge and is adapted to squeeze excess coating material out of said roller portion, and said first canted wall portion and said second canted wall portion are juxtaposed to each such that they form an angled groove which is complementary to the exterior corner formed by said back-to-back first canted peripheral edge and said second canted peripheral edge.

3. The apparatus of claim 2 wherein said juxtaposed first canted peripheral edge and second canted peripheral edge are formed as a unified, integrated structure.

4. The apparatus of claim 2 wherein said exterior corner formed by said back-to-back first canted peripheral edge and second canted peripheral edge has an outer corner angle which is approximately a right angle.

5. The apparatus of claim 1 wherein said bearing portion of said roller assembly includes:

a first end-bearing member rotatably connected to said handle portion, a plurality of resilient bands connected to said first end-bearing member, and a second end-bearing member connected to said resilient bands.

6. The apparatus of claim 1 wherein said squeeze area of said tray assembly is canted with respect to said pool region.

7. The apparatus of claim 1 wherein said wall-clip assembly includes an inverted U-shaped member adapted to fit over an edge of a wall.

* * * * *